US006000724A

United States Patent [19]

Holway

[11] Patent Number: 6,000,724

[45] Date of Patent: Dec. 14, 1999

[54] WALLET/POCKET CREDIT CARD ACCOUNTING BOOK WITH CREDIT CARD AND RECEIPT HOLDER

[76] Inventor: James Holway, 9940 E. Costilla Ave., Suite M, Englewood, Colo. 80112

[21] Appl. No.: 08/927,369

[22] Filed: Sep. 9, 1997

[51] Int. Cl.[6] ..... B65D 27/30

[52] U.S. Cl. ..... 283/66.1; 281/31; 281/36; 281/37; 283/57

[58] Field of Search ..... 281/15, 18, 19.1, 281/17, 22, 26, 29, 31, 30, 34, 35, 36, 37; 283/57, 58, 59, 56, 60.1, 60.2, 66.1

[56] References Cited

U.S. PATENT DOCUMENTS

| | | | |
|---|---|---|---|
| 748,631 | 1/1904 | Mitchell | 281/31 X |
| 4,465,305 | 8/1984 | Bateman et al. | 281/31 |
| 4,640,413 | 2/1987 | Kaplan et al. | 281/31 X |
| 4,832,372 | 5/1989 | Young | 281/31 |
| 5,294,208 | 3/1994 | Tremmel, Jr. et al. | 281/31 X |
| 5,350,249 | 9/1994 | Peters | 281/31 X |

*Primary Examiner*—Andrea L. Pitts
*Assistant Examiner*—Henry W. H. Tsai
*Attorney, Agent, or Firm*—Edwin H. Crabtree; Ramon L. Pizarro; Donald W. Margolis

[57] ABSTRACT

A wallet/pocket credit card accounting book used for keeping records of credit card charges and credit card credits. The accounting book provides a convenient way of storing a credit card and storing charge and credit receipts. The wallet/pocket accounting book includes a front cover with a side of the front cover having a back cover fold line. The back cover fold line joins together the front cover and a back cover. Disposed at the bottom of the front cover is a pocket cover fold line. The pocket cover fold line joins together the front cover and a pocket cover. The pocket cover includes a credit card slit therein. The credit card slit is used for receiving a portion of a credit card therethrough and storing the credit card inside the wallet/pocket accounting book. The pocket cover also includes a first flap fold line and a second flap fold line. The first and the second flap fold lines join the pocket cover with a first and a second flap. The first and the second flap, when folded, are attached to a back of the front cover for forming a pocket between the pocket cover and the back of the front cover. The pocket is used for receiving and storing charge receipts. The wallet/pocket accounting book also includes a plurality of lined pages for keeping records of charges and credits, dates of purchase and items bought.

10 Claims, 1 Drawing Sheet

WALLET/POCKET CREDIT CARD ACCOUNTING BOOK WITH CREDIT CARD AND RECEIPT HOLDER

BACKGROUND OF THE INVENTION (a) Field of the Invention

This invention relates to accounting books and more particularly, but not by way of limitation, to a wallet/pocket accounting book for storing a credit card and credit and charge receipts.

(b) Discussion of Prior Art

Heretofore, there have been a variety of different types of of pocket accounting books. In U.S. Pat. No. 2,531,606 to Broughton, a pocket case for holding a memorandum pad is described. The case includes a front wall member and a rear wall member joined together by a fold line. The front wall has a transverse slit for receiving a portion of the pad therethrough. Also, U.S. Pat. No. 2,467,656 to Broughton describes a pocket case for holding a memorandum pad.

In U.S. Pat. No. 3,537,728 to Reese, a credit card holder and record book is illustrated. The holder and book are made of flat paper stock with die cuts and fold lines for forming the holder. In U.S. Pat. No. 2,828,975 to Wright, the construction of a pocket secretary is described. The pocket secretary includes side by side pockets for removable cards.

None of the above mentioned patents describe the combination of structure, unique features and advantages of the subject pocket credit card accounting book as described herein.

SUMMARY OF THE INVENTION

In view of the foregoing, it is a primary object of the present invention to provide a convenient way of storing a credit card and storing credit card receipts.

Another object of the invention is the invention provides for keeping a continuous log of credit card charges and credits which can be used for keeping tax records and reconciling charges and credits with monthly statements from a bank or credit card company.

Still another object of the invention is the front cover of the accounting book includes a pocket for receiving credit card receipts and a slit in the pocket is used for receiving a credit card, debit card, ATM card and various other types of bank cards therethrough.

Yet another object of the accounting book is the book is sized for receipt in a coat pocket, a wallet, a pocket book or pocket of a shirt for ease in carrying and accessibility when needed during a purchase.

The wallet/pocket credit card accounting book includes a front cover with a side of the front cover having a back cover fold line. The back cover fold line joins together the front cover and a back cover. Disposed at the bottom of the front cover is a pocket cover fold line. The pocket cover fold line joins together the front cover and a pocket cover. The pocket cover includes a credit card slit therein. The credit card slit is used for receiving a portion of a credit card therethrough and storing the credit card inside the wallet/pocket accounting book. The pocket cover also includes a first flap fold line and a second flap fold line. The first and the second flap fold lines join the pocket cover with a first and a second flap. The first and the second flap, when folded, are attached to a back of the front cover for forming a pocket between the pocket cover and the back of the front cover. The pocket is used for receiving and storing charge receipts. The wallet/pocket accounting book also includes a plurality of lined pages for keeping records of charges and credits, dates of purchase and items bought.

These and other objects of the present invention will become apparent to those familiar with accounting books used in travel from the following detailed description, showing novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
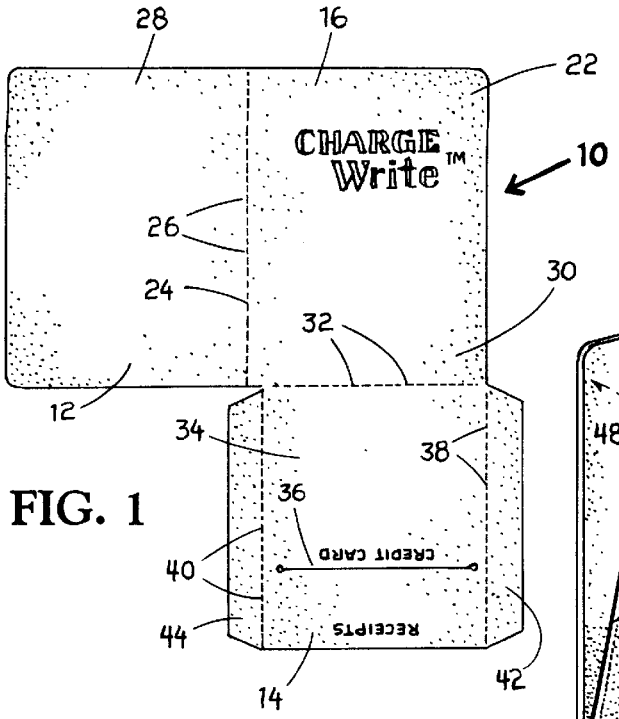
FIG. 1 is a front view of a front cover, back cover and pocket cover which makes up the cover of the wallet/pocket credit card accounting book.

In FIG. 1, a front view of a front cover 10, a back cover 12 and pocket cover 14 is illustrated making up a one-piece cover 16 of a wallet/pocket credit card accounting book. The wallet/pocket credit card accounting book has a general reference numeral 18 and is shown completely assembly with a plurality of lined pages 20 in FIG. 4.

A front 22 of the front cover 10 is shown with a brand name adopted by the subject inventor and called "CHARGE WRITE" for identifying the wallet/pocket credit card accounting book 18. The front cover 10 includes on a side 24 a vertical back cover fold line 26 shown in dotted lines. The fold line 26 joins together the front cover 10 and the back cover 12. In this view, a front 28 of the back cover 12 is shown.

Disposed at a bottom 30 of the front cover 10 is a horizontal pocket cover fold line 32. The pocket cover fold line 32 joins together the front cover 10 and the pocket cover 14. A front 34 of the pocket cover 14 is shown in this drawing. The pocket cover 14 includes a horizontal credit card slit 36 for receiving a credit card therethrough and storing the credit card inside the wallet/pocket accounting book 18. The pocket cover 14 also includes on opposite sides a vertical first flap fold line 38 and a vertical second flap fold line 40. The fold lines 38 and 40 are shown in dotted lines. The first and the second flap fold lines 38 and 40 join the pocket cover 14 with a first flap 42 and a second flap 44. Note that the second flap fold line 40 is offset and to the right of the vertical back cover fold line 26 so that when the pocket cover 14 is folded against the front cover 10, the second flap 44, when folded, does not interfere with the fold line 26 and the lined pages 20 attached thereto as shown in FIG. 4.

Figure 2:
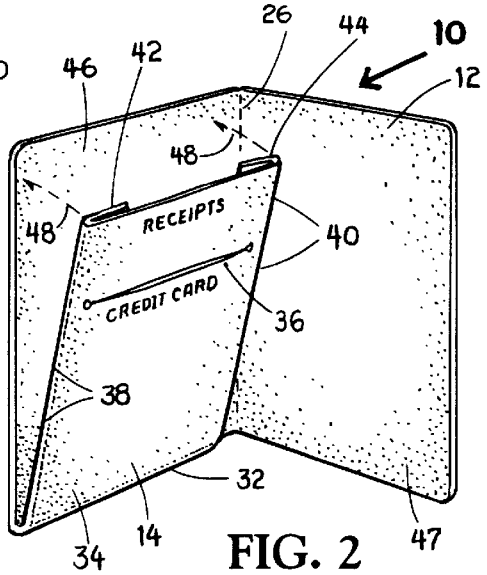
FIG. 2 is a perspective view of the front cover and back cover with the pocket cover folded and positioned for attachment to the back of the front cover.
Figure 3:
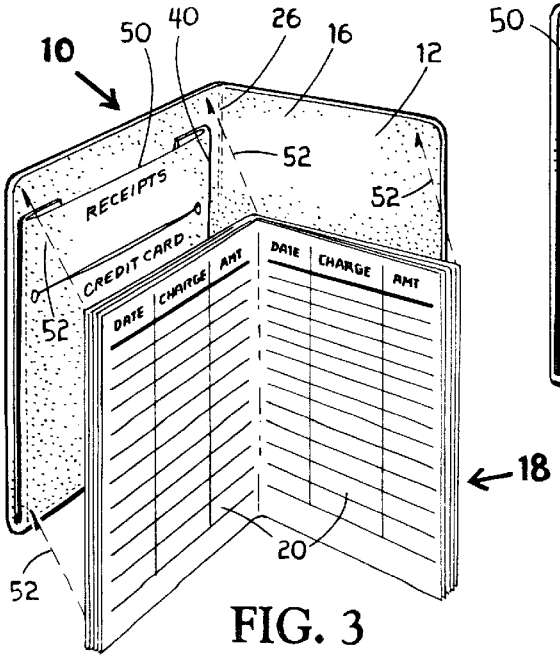
FIG. 3 is a perspective view of the front and back cover with the lined pages of the accounting book positioned for attachment to a vertical back cover fold line which divides the front and back cover.

In FIG. 2, a perspective view of the one-piece cover 16 is shown and turned around for illustrating a back 46 of the front cover 10 and a back 47 of the back cover 12. In this view, the pocket cover 14 is shown folded upwardly along pocket cover fold line 32 and positioned next to the back 46 of the front cover 10. Also, the pocket cover 14 is shown with the first and second flaps 42 and 44 folded inwardly along fold lines 38 and 40. The flaps 42 and 44 are attached, as indicated by arrows 48, to the back 46 of the front cover 10 using an adhesive or other means of attachment. The pocket cover 14, when attached to the front cover 10, forms a pocket 50 as shown in FIGS. 3 and 4. The pocket 50 is used for receiving and storing charge and credit receipts therein. The charge and credit receipts are not shown in the drawings.

In FIG. 3, a perspective view of the one-piece cover 16 is shown in an open position for receiving the lined pages 20 of the accounting book 18 as indicated by arrows 52. The lined pages 20 are attached to the cover 16 along the vertical back cover fold line 26 using staples or any other common means for securing pages in a small book. In this view, the lined pages are shown with typical headings such as Date of Transaction, Charge or Credit and Amount of Purchase. In this manner, the user of the accounting book 18 can keep up-to-date records of purchases and credits using his or her credit card.

Figure 4:
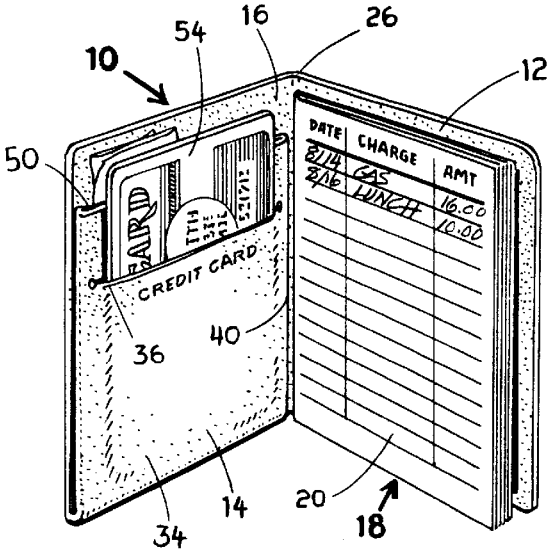
FIG. 4 is a perspective view of the wallet/pocket credit card accounting book with the lined pages mounted inside the accounting book and a credit card received in a horizontal slit in the pocket cover for storage therein.

In FIG. 4, a perspective view of the wallet/pocket credit card accounting book 18 is shown with the lined pages 20 mounted inside the accounting book 18. Also in this drawing, a bank credit card 54 is shown with a portion of the card 54 received through the credit card slit 36 and stored inside the pocket 50. While the bank credit card 54 is discussed herein, the card 54 can also be a debit card, an ATM card, and other types of bank cards. Also shown in this drawing are two entrees made on one of the lined pages 20 for keeping accurate records when using the credit card 54. From reviewing this drawing, it can be seen that the credit card accounting book 18 is slightly larger than the credit card 54. The size of the accounting book 18 provides for convenience in carrying the book in a wallet, a coat pocket, a shirt pocket and other articles of clothing.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. An accounting book used for keeping records of credit card charges and credit card credits, storing a credit card and storing charge and credit receipts, the accounting book comprising:

a front cover with a side of said front cover having a vertical back cover fold line along one side thereof and a horizonal pocket cover fold line along a bottom thereof;

a back cover, the vertical back cover fold line joining together said front cover and said back cover; and a pocket cover, the horizontal pocket cover fold line joining together said front cover and said pocket cover, said pocket cover, when folded upwardly along the horizontal pocket cover fold line, attached to a back of said front cover forming an open top pocket between the back of said front cover and a back of said pocket cover, said open top pocket adapted for receiving charge and credit receipts therein;

said pocket cover having a height less than a height of said front cover so that when said open top pocket is formed, the back of said front cover includes an exposed upper portion above a top of said open top pocket, the exposed upper portion of said front cover acting as a guide for inserting the charge and credit receipts in said open top pocket.

2. The accounting book as described in claim 1 wherein said pocket cover includes a vertical first flap fold line and a vertical second flap fold line, the first flap fold line joining said pocket cover with a first flap, the second flap fold line joining said pocket cover with a second flap, said first and the second flaps, when folded, are attached to the back of said front cover for forming said open top pocket.

3. The accounting book as described in claim 2 wherein said first flap and said second flap are glued to the back of said front cover.

4. The accounting book as described in claim 1 said pocket cover includes a horizontal credit card slit therein, said credit card slit adapted for receiving a portion of the credit card therethrough and storing the credit card inside said open top pocket.

5. The accounting book as described in claim 1 further including a plurality of lined pages for record keeping, said lined pages attached along a length of the vertical back cover fold line.

6. An accounting book used for keeping records of credit card charges and credit card credits, storing a credit card and storing charge and credit receipts, the accounting book comprising:

a front cover with a side of said front cover having a vertical back cover fold line along one side thereof and a horizonal pocket cover fold line along a bottom thereof;

a back cover, the vertical back cover fold line joining together said front cover and said back cover; and a pocket cover, the horizontal pocket cover fold line joining together said front cover and said pocket cover, a first flap, said first flap joined to one side of said pocket cover by a vertical first flap fold line; and a second flap, said second flap joined to an opposite side of said pocket cover by a vertical second flap fold line;

said pocket cover when folded upwardly along the horizontal pocket cover fold line and when said first and second flaps are folded vertically along the first and second flap fold lines, said first and second flaps attached to a back of said front cover forming an open top pocket between the back of said front cover and a back of said pocket cover, said open top pocket adapted for receiving charge and credit receipts therein;

said pocket cover having a height less than a height of said front cover so that when said open top pocket is formed, the back of said front cover includes an exposed upper portion above a top of said open top pocket, the exposed upper portion of said front cover acting as a guide for inserting the charge and credit receipts in said open top pocket.

7. The accounting book as described in claim 6 wherein said first flap and said second flap are glued to the back of said front cover.

8. The accounting book as described in claim 6 said pocket cover includes a horizontal credit card slit therein, said credit card slit adapted for receiving a portion of the credit card therethrough and storing the credit card inside said open top pocket.

9. The accounting book as described in claim 6 further including a plurality of lined pages for record keeping, said lined pages attached along a length of the vertical back cover fold line.

10. An accounting book used for keeping records of credit card charges and credit card credits, storing a credit card and storing charge and credit receipts, the accounting book comprising:

a front cover with a side of said front cover having a vertical back cover fold line along one side thereof and a horizonal pocket cover fold line along a bottom thereof;

a back cover, the vertical back cover fold line joining together said front cover and said back cover;

a plurality of lined pages for record keeping, said lined pages attached along a length of the vertical back cover fold line;

a pocket cover, the horizontal pocket cover fold line joining together said front cover and said pocket cover, a first flap, said first flap joined to one side of said pocket cover by a vertical first flap fold line; and a second flap, said second flap joined to an opposite side of said pocket cover by a vertical second flap fold line;

said pocket cover when folded upwardly along the horizontal pocket cover fold line and when said first and second flaps are folded vertically along the first and second flap fold lines, said first and second flaps glued to a back of said front cover forming an open top pocket between the back of said front cover and a back of said pocket cover, said open top pocket adapted for receiving charge and credit receipts therein;

said pocket cover having a horizontal credit card slit therein, said credit card slit adapted for receiving a portion of the credit card therethrough and storing the credit card inside said open top pocket;

said pocket cover having a height less than a height of said front cover so that when said open top pocket is formed, the back of said front cover includes an exposed upper portion above a top of the open top pocket, the exposed upper portion of said front cover acting as a guide for inserting the charge and credit receipts in said open top pocket.

* * * * *